United States Patent [19]

Feldman et al.

[11] 4,141,693

[45] Feb. 27, 1979

[54] MANGANESE CONTAINING FUELS

[75] Inventors: Daniel W. Feldman, Beachwood; James W. Sprague, Bedford; Franklin Veatch, Cleveland, all of Ohio

[73] Assignee: Standard Oil Company (Ohio), Cleveland, Ohio

[21] Appl. No.: 530,575

[22] Filed: Dec. 18, 1974

[51] Int. Cl.[2] ..... C01L 1/22

[52] U.S. Cl. ..... 44/68

[58] Field of Search ..... 44/68

[56] References Cited

U.S. PATENT DOCUMENTS

| | | | |
|---|---|---|---|
| 1,761,810 | 6/1930 | Bjerregaard | 44/78 |
| 1,884,559 | 10/1932 | Calcott et al. | 44/78 |
| 1,945,521 | 2/1934 | Downing et al. | 44/78 |
| 1,995,615 | 3/1935 | Jaeger | 44/70 |
| 2,014,200 | 9/1935 | Downing et al. | 44/78 |
| 2,021,088 | 11/1935 | Pevere | 44/72 |
| 2,324,118 | 7/1943 | Sweeney | 44/72 |
| 2,334,006 | 11/1943 | Holm | 44/70 |
| 2,818,417 | 12/1957 | Brown et al. | 44/68 |
| 2,913,413 | 11/1959 | Brown | 44/68 |
| 3,244,736 | 4/1966 | Coffield et al. | 44/68 |

OTHER PUBLICATIONS

Trinidad & Tobago Patent 72/1958—dated Oct. 9, 1958.

*Primary Examiner*—Winston A. Douglas
*Assistant Examiner*—Y. Harris-Smith
*Attorney, Agent, or Firm*—David J. Untener; Herbert D. Knudsen; L. W. Evans

[57] ABSTRACT

The invention is gasoline containing an added manganese compound to improve the octane rating of the gasoline and including a small amount of an additive selected from a group consisting of a monocarboxylic acid or its ester, a dicarboxylic acid or its monoester or diester, an alkylamine, phenol, a substituted phenol or mixture thereof.

10 Claims, No Drawings

MANGANESE CONTAINING FUELS

BACKGROUND OF THE INVENTION

It is well known that gasoline additives have been under attack due to environmental reasons. As a result, there has been a search for suitable octane improvers that do not contain lead. Various manganese compounds have been found and are known to improve the octane rating of gasoline compositions, see for example U.S. Pat. No. 3,127,351.

Discovery of these new manganese additives has presented additional problems in that now compatible additives must be found which alleviate problems caused by the use of manganese.

One problem encountered with the use of manganese additives is spark plug gap bridging and the resultant misfiring and engine malfunction. These misfires appear to be caused by formation during combustion of manganese containing particles which become lodged in the spark plug gap. For automobiles equipped with catalytic converters, such misfires overload the catalytic muffler with hydrocarbons to be oxidized and cause overheating of the converter. Also, the particles formed upon combustion of manganese containing fuels can cause clogging of the catalytic mufflers.

SUMMARY OF THE INVENTION

These problems of the art can be solved by the addition of certain organic compounds to the fuel. More specifically, the invention is gasoline containing an added manganese compound to improve the octane rating of the gasoline and including a small amount of an additive having less than 20 carbon atoms and being selected from the group consisting of a monocarboxylic acid or its ester, a dicarboxylic acid or its monoester or diester, an alkylamine, phenol, substituted phenol or mixture thereof.

The base fuel employed in the invention is gasoline containing a suitable manganese additive. The gasoline compositions employed in this fuel are well known in the art. The manganese compounds, although less well known, are readily available on a commercial basis. Suitable manganese compounds, such as the cyclopentadienyl manganese tricarbonyls, have been invented and publicized by various companies, especially the Ethyl Corporation. One of the most prominent of the manganese additives is methyl cyclopentadienyl manganese tricarbonyl. Use of this additive in the base fuel of the present invention is especially preferred.

The central feature of the present invention is the discovery that certain organic compounds, when added to the manganese containing base fuel, are very desirable. These additives compounds are broadly described above. The chemicals falling within the broad definitions are well known and readily available on a commercial scale. Representative examples of such compounds include: monocarboxylic acids and their esters such as, acetic acid, propionic acid, butyric acid, methyl butyrate, isobutyl butyrate, octanoic acid; dicarboxylic acids and their esters such as oxalic acid, maleic acid, succinic acid, adipic acid and their methyl, ethyl, butyl and hexyl esters; alkylamines such as t-butylamine, hexylamine, di-butylamine, triethylamine, and tributylamine; pehnol and substituted phenols such as methylphenol, t-butylphenol, chlorophenol, bromophenol and the like. These additives of the present invention contain up to 20 carbon atoms and must be soluble in gasoline and volatile to the extent that they are vaporized within the combustion chamber to provide for a reduction in the misfires of the engine. Preferred additives contain less than 10 carbon atoms. Of particular importance in the invention is acetic acid, the esters of acetic acid, the monoalkylamines, phenol and alkylphenols.

The concentration of the additive in the gasoline may vary widely. In normal practice, the concentration of the additive is less than 5 grams per gallon of gasoline with concentrations of less than 3 grams of the additive per gallon of gasoline being of particular importance. These concentrations provide the effective relief from misfires, while at the same time not adversely affecting the performance of the gasoline composition.

The present invention is not only directed toward the final gasoline composition but is also directed towards the additive package when combined with gasoline gives the gasoline composition described above. The additive package broadly contains the manganese compound and the additive discussed above.

In the additive package, the comparative amounts of the manganese compound and the additive of the invention may vary widely depending upon the final concentration desired. Normally, the weight ratio of the manganese compound to the additive of the invention ranges from 50:1 to 1:5.

In addition to the additive specifically required by the present invention, it is anticipated that the gasoline composition actually used in commerce would contain other additives that are known and developed which would not interfere with the functions of the additives of the invention. Thus, for example, in addition to the manganese additive and the ester of acetic acid, inhibitors or other additives could be employed. It has been specifically found in this respect that alkyl tin compounds appear to be very desirable co-additives when the possibility of lead contamination exists.

SPECIFIC EMBODIMENTS

All examples of the present invention were run using a base fuel having an initial octane rating of about 93 R.O.N. To this fuel was added 0.2 grams per gallon of manganese as methyl cyclopentadienyl manganese tricarbonyl. In addition, the fuel contained 34 p.p.m. Oronite OGA-472 which is a detergent made of a polybutene amine, and ⅛ of one percent SEB-78 which is a lubricating oil component to maintain induction system cleanliness. This fuel exhibited a 96 R.O.N.

All experiments were run on a Kohler K91 engine. This engine was rated at 4 horsepower and has a single cylinder of cast iron. For evaluating resistance to misfiring, the engine was run at 3600 rpm with no added load except for an integral cooling fan. For the tests, an extended core plug of moderately high heat range was selected. This plug has a designation from AC of AC456. The heat range was suitable for turnpike as well as around-town driving conditions. The extended core was chosen to increase the test severity by exposing the plug to more of the products of combustion. To further increase the severity of the test, the electrode gap was reduced to 0.015 inches. These severe conditions were chosen to obtain the most informative test results in the shortest period of time. The results of these experiments were later confirmed on full-size automobile engines.

Each of the tests was run with a clear freshly set plug which would give reliable ignition. Each test was begun with fresh oil and a clean combustion chamber. The engine was run for a period of 19 hours to provide adequate plug deposits. Then for a period of one hour, the number of misfires were counted. In some cases, the engine stalled before a misfire count could be made. To detect misfire, the exhaust line pressure near the exhaust port was monitored with a Kistler pressure pickup. The exhaust line pressure depended on the ignition success of the plug. When a misfire occurred, a counter recorded the misfire.

Comparative Examples A–C and Examples 1–23 — Effect of various additives on the number of misfires.

Using the manganese fuel and the engine described above, a number of experiments were run to determine the effectiveness of the various additives and the concentrations of these additives. The results of these tests are shown in the following table. It is seen from these results that there is a significant variation in effectiveness as different concentrations and additives are employed.

Table

Effect of Various Additives on the Number of Misfires Using a Manganese Fuel

| Example | Additive, gr./gal. | Misfires in 20th Hour |
|---|---|---|
| | None | |
| Comp. A | 0 | Stalled 14.9 hours |
| Comp. B | 0 | Stalled 16.2 hours |
| Comp. C | 0 | 13,100 |
| | Ethylene Diacetate | |
| 1 | 2.66 | 1,320 |
| 2 | 2.66 | 1,220 |
| 3 | 2.66 | 3,710 |
| 4 | 2.66 | Stalled 18.1 hours |
| 5 | 1.06 | 440 |
| 6 | 0.53 | 4,040 |
| 7 | 0.27 | 810 |
| 8 | 0.13 | 5,030 |
| 9 | 0.13 | 810 |
| 10 | 0.13 | 1,080 |
| | 2-ethylhexoic acid | |
| 11 | 0.53 | 1,480 |
| | Acetic acid | |
| 12 | 0.22 | 161 |
| | t-butyl acetate | |
| 13 | 0.42 | 1,381 |
| 14 | 0.42 | 580 |
| 15 | 0.14 | Stalled 18.3 hours |
| | t-butyl amine | |
| 16 | 2.66 | 1,341 |
| 17 | 0.67 | Stalled 19.5 hours |

Table-continued

Effect of Various Additives on the Number of Misfires Using a Manganese Fuel

| Example | Additive, gr./gal. | Misfires in 20th Hour |
|---|---|---|
| 18 | 0.54 | 112 |
| 19 | 0.27 | 340 |
| 20 | 0.27 | 3 |
| 21 | 0.27 | 266 |
| | Phenol | |
| 22 | 1.70 | 1,879 |
| 23 | 0.34 | 2,930 |

We claim:

1. Gasoline containing an added gasoline soluble manganese compound to improve the octane rating of the gasoline and including an additive having less than 20 carbon atoms and being selected from the group consisting of a monocarboxylic acid or its ester, a dicarboxylic acid or its monoester or diester, an alkylamine, phenol, a substituted phenol of less than 10 carbon atoms or mixture thereof, in a weight ratio of manganese compound to the additive of from 50:1 to 1:5.

2. The gasoline of claim 1 wherein the additive has less than 10 carbon atoms.

3. The gasoline of claim 1 wherein the additive is acetic acid.

4. The gasoline of claim 1 wherein the additive is an ester of acetic acid.

5. The gasoline of claim 1 wherein the additive is a monoalkylamine.

6. The gasoline of claim 1 wherein the additive is phenol.

7. The gasoline of claim 1 containing less than 3 grams of the additive per gallon of gasoline.

8. The gasoline of claim 1 wherein the added manganese compound is methylcyclopentadienyl manganese tricarbonyl.

9. An additive package for gasoline comprising a gasoline soluble manganese compound to improve the octane rating of the gasoline and an additive selected from the group consisting of a monocarboxylic acid or its ester, a dicarboxylic acid or its monoester or diester, an alkylamine, phenol, a substituted phenol or mixture thereof, wherein the weight ratio of manganese compound to the additive is from 50:1 to 1:5.

10. The gasoline of claim 1 wherein the additive is an alkylphenol of less than 10 carbon atoms.

* * * * *